US005361439A

United States Patent [19]

Malchow

[11] Patent Number: 5,361,439

[45] Date of Patent: Nov. 8, 1994

[54] METHOD AND APPARATUS FOR SPINNING AND DRAINING AUTOMATIC CLOTHES WASHER

[75] Inventor: Gregory L. Malchow, Oshkosh, Wis.

[73] Assignee: Speed Queen Company, Ripon, Wis.

[21] Appl. No.: 135,215

[22] Filed: Oct. 12, 1993

[51] Int. Cl.[5] ..... D06F 23/04

[52] U.S. Cl. ..... 8/158; 8/159; 68/12.12; 68/12.14; 68/12.19; 68/23.4

[58] Field of Search ..... 8/158, 159; 68/12.12, 68/12.14, 12.19, 23.4, 208

[56] References Cited

U.S. PATENT DOCUMENTS 4,782,544 11/1988 Nystuen et al. ..... 68/12.14 X
4,843,671 7/1989 Hirooka et al. ..... 68/12.14 X

FOREIGN PATENT DOCUMENTS 2354993 5/1975 Germany ..... 8/158
5982 1/1977 Japan ..... 68/208
149192 8/1984 Japan ..... 68/12.19
162980 7/1986 Japan ..... 68/208

*Primary Examiner*—Philip R. Coe
*Attorney, Agent, or Firm*—William R. Clark

[57] ABSTRACT

A method and apparatus for spinning and draining an automatic clothes washer after a wash or rinse cycle. After the water is pumped down, the spin drive and drain pump are activated with an on and off schedule of increasing on times, but constant off times. For example, the spin drive and drain pump may be activated for on times of 10, 15, 20, etc. with interleaved off times of 5 seconds. The off times of the drain pump allow suds in the drain pump to be purged, and thereby increase the steady state flow rate of the drain pump.

12 Claims, 4 Drawing Sheets

METHOD AND APPARATUS FOR SPINNING AND DRAINING AUTOMATIC CLOTHES WASHER

BACKGROUND OF THE INVENTION

The field of the invention generally relates to top loading automatic clothes washers, and more particularly relates to a method and apparatus for spinning and draining such clothes washers.

As is well known, a top loading automatic clothes washer typically sequences through various cycles to accomplish automatic washing of a clothes load. In particular, after clothes are loaded into an automatic washing machine, an operator actuable control is used to initiate a wash sequence that starts by filling the wash tub with water. Detergent is generally added before or during the filling process. Following an agitate cycle, the clothes are spun dry by draining the water and spinning an inner perforate spin basket which holds the clothes. Then, following a rinse cycle, the clothes are spun dry again. In a spin cycle of one prior art washing machine, the drain pump and the drive for the spin basket are initiated simultaneously. That is, water is pumped from the wash tub at the same time that the inner perforate spin basket is spinning. One problem with this arrangement is that the clothes are centrifuged against the walls of the spin basket, and much of the water exits the spin basket horizontally through the clothes thereby depositing lint on the clothes. Simply stated, the clothes act as a lint filter and undesirably collect lint.

In another prior art clothes washer, the drain pump is activated first, and the drive for the spin basket is only activated after the water has been pumped down. This arrangement has been referred to as a "neutral drain" system because the drive for the spin basket is in neutral while the water is being drained from the wash tub. The above described problem of collecting lint on the clothes is improved with a neutral drain system. That is, there is no spinning during the initial pump down, so the water is not driven horizontally through the clothes. Further, this arrangement has the advantage of not requiring a relatively large pump. More specifically, the flow rate of the drain pump can be relatively low because the pumping down of the water is independent of spinning, so the time to empty the wash tub is not critical. However, one remaining drawback is that the drain pump may tend to cavitate after the spin basket starts to spin. In particular, as the water is extracted from the clothes by spinning, a relatively high concentration of suds tends to be generated. The suds are compressible, and can not be effectively pumped by the drain pump. That is, the pump cavitates, or circulates the same compressible fluid, thereby reducing the net outflow.

One prior art approach for reducing cavitation is to pulse or intermittently activate the drive to the spin basket during an initial stage of a spin cycle. Suds are generated faster at higher spin speeds, and the pulsing prevents the spin basket from getting up to a maximum spin speed until most of the liquid has been extracted from the clothes. As a result, the generation of suds is reduced. However, cavitation is still a problem, and it reduces the effectiveness and efficiency of a given pump.

SUMMARY OF THE INVENTION

In an automatic top-loading clothes washer having a wash tub with a perforated inner spin basket rotatable by a spin drive and a drain pump for pumping water from the wash tub, a method of draining water from the wash tub and spinning the spin basket to extract water from clothes in the spin basket comprises the steps of activating the drain pump to pump down water in the wash tub, and activating the spin drive with a predetermined on and off schedule to prevent the spin basket from reaching a maximum spin speed during an initial period of a spin cycle after pumping down water in the wash tub. In accordance with the invention, the method further includes the step of activating the drain pump with a predetermined on and off schedule during the initial period of the spin cycle to purge the pump of compressible fluid such as suds during off time.

It is preferable that the predetermined on and off schedule of the spin drive has increasing on times until the maximum spin speed is reached, while maintaining constant off times. It may be preferable that the on and off times of the spin drive and the drain pump be in unison. For example, after the water is pumped down by the drain pump, it may be preferable to activate the spin drive and the drain pump for approximately 10 seconds, and then deactivate both for a period of approximately 5 seconds. Next, the spin drive and the drain pump may be activated for approximately 15 seconds followed by a deactivated period of approximately 5 seconds.

With such method, the clothes in the spin basket do not collect substantial lint because the water is pumped down before the spinning of the spin basket is commenced. Further, during an initial period of a spin cycle, the spin drive is pulsed on and off according to a predetermined schedule to prevent the spin basket from reaching a maximum spin speed such as, for example, 600 R.P.M during the initial period. The generation of suds is related to the spin speed, so limiting the spin speed helps to limit or control the generation of suds. Further, by pulsing the drain pump on and off with the spin drive, suds are allowed to clear or purge from the drain pump thereby reducing cavitation. That is, when the drain pump is turned off for a brief period of time such as 5 seconds, suds in the drain pump float up thereby leaving incompressible water in the pump. Thus, when the drain pump comes back on, the time to prime the pump is decreased and maximum pumping flow rate is achieved. Even though the drain pump is on less time with the reduced duty cycle, steady state analysis shows that more fluid may be pumped than when the drain pump is on continuously. Therefore, a smaller pump can be used, and associated cost and energy savings can be realized.

The invention can also be practiced by an automatic top-loading clothes washer comprising a wash tub, a perforated spin basket disposed within the wash tub, means for filling the wash tub with water, and an agitator disposed in the spin basket. The washer further includes a drain pump coupled to the wash tub for pumping water from the wash tub and a spin drive for spinning the spin basket to extract water from the clothes. The washer also includes a controller comprising means for first activating the drain pump to pump down water in the wash tub, and then pulsing activation of the spin drive and the drain pump on a predetermined schedule of on and off times to extract water from the clothes while preventing the spin basket from reaching a maximum spin speed during an initial period of a spin cycle and also purging compressible fluid from the drain pump during off times.

BRIEF DESCRIPTION OF THE DRAWINGS

The foregoing objects and advantages of the invention will be more fully understood by reading the following Description of the Preferred Embodiment with reference to the drawings wherein.

DESCRIPTION OF THE PREFERRED EMBODIMENT

Figure 1:
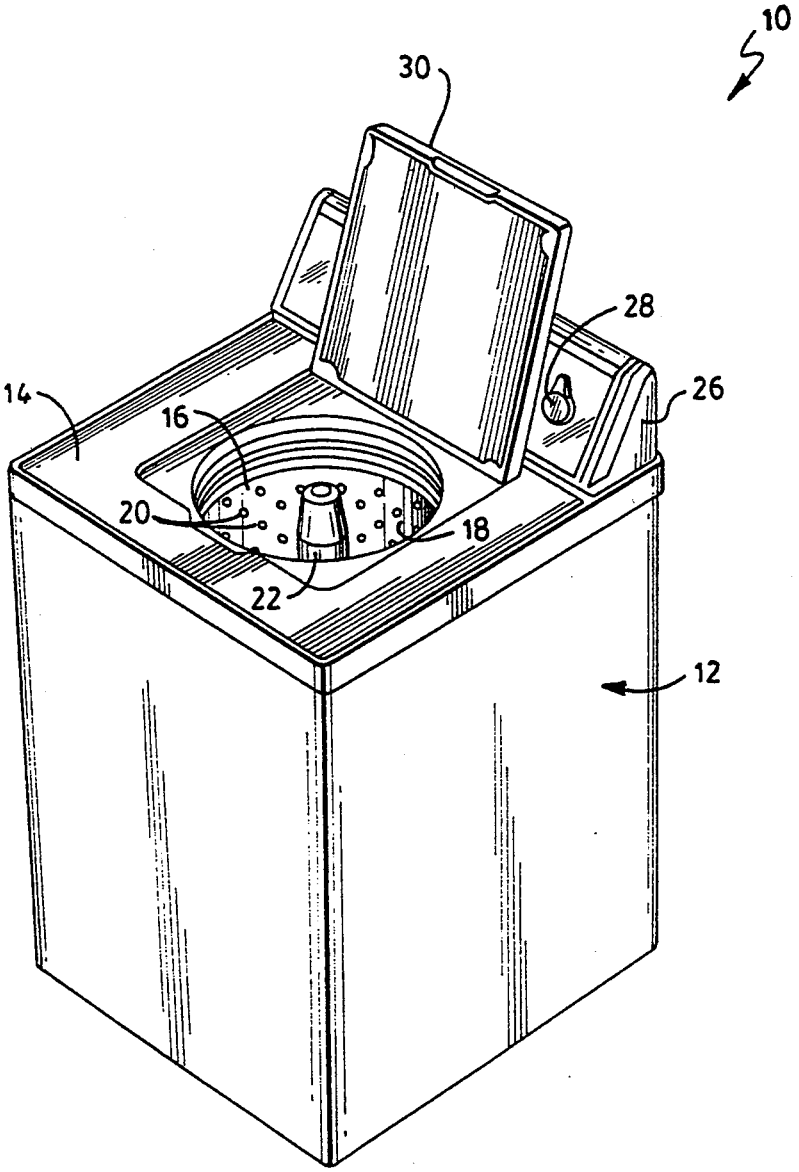
FIG. 1 is a front perspective view of an automatic top-loading clothes washer.

Referring to FIG. 1, an automatic top-loading clothes washer 10 includes a cabinet 12 with a top panel 14 having an access opening 16 down into a spin basket 18 having perforations 20. An agitator 22 is centrally located within the spin basket 18. A control console 26 is mounted to the top panel 14 and includes one or more control knobs 28.

Figure 2:
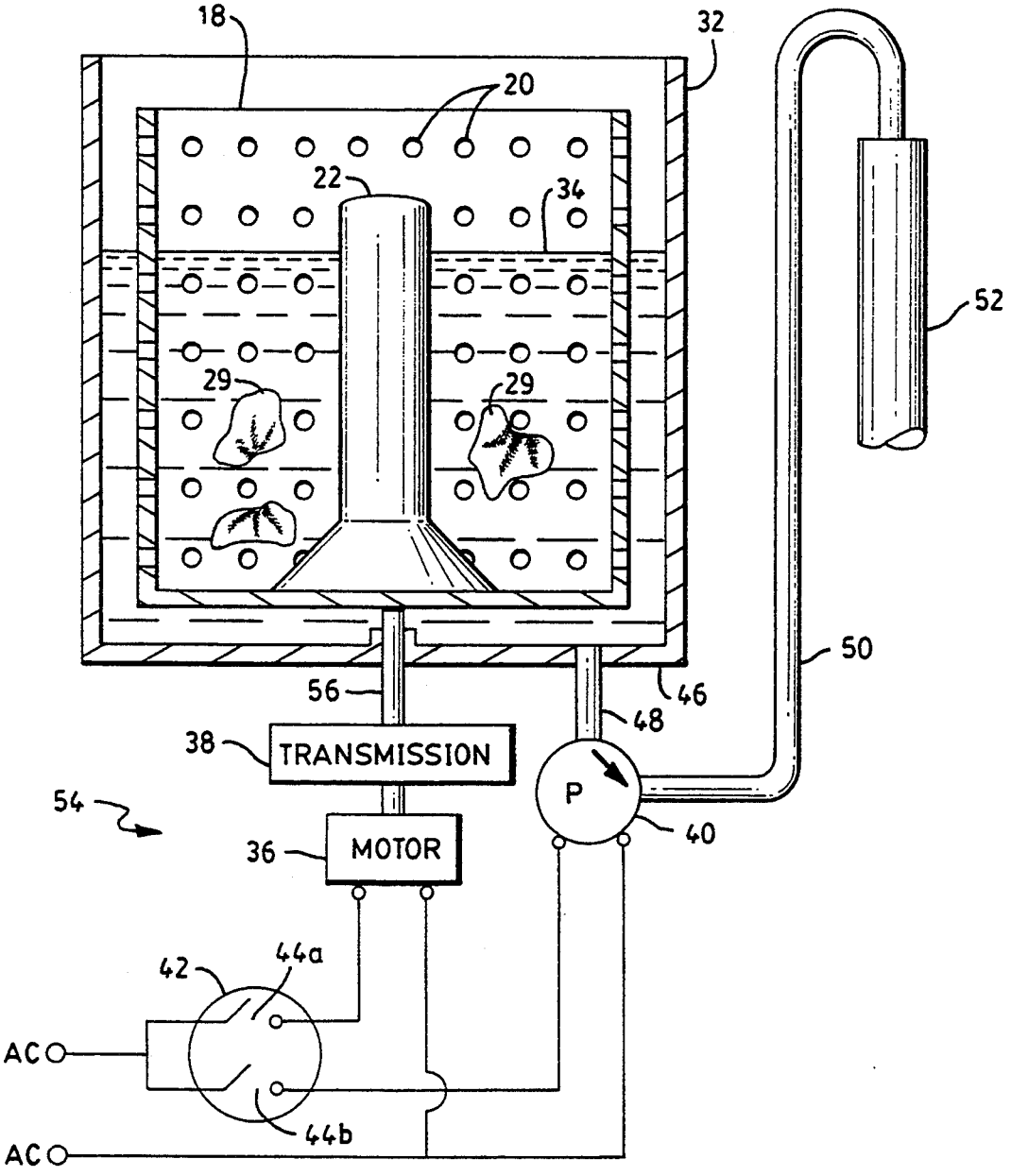
FIG. 2 is a pictorial representation of a cross-section of the clothes washers of FIG. 1 with control and drive components.

Also referring to FIG. 2, clothes 29 are loaded into spin basket 18 through access opening 16 and, after lid 30 is closed, control knobs 28 are used to initiate a sequence of automatic wash cycles or operations. More specifically, the wash tub 32 surrounding the spin basket 18 is filled with water 34, and then motor 36 drives transmission 38 to rotate agitator 22 back and forth in a reciprocating motion through a predetermined stroke arc to agitate the clothes 29 during a wash cycle. Typically, transmission 38 is used to provide the reciprocating motion, but a reversing motor 36 could also be used. After wash water 34 which includes detergent is drained and the clothes 29 are spun dry in a manner to be described in detail, the wash tub 32 is filled with rinse water which is subsequently drained before another spin operation.

Still referring to FIG. 2, the first step in removing water 34 from wash tub 32 after a wash or rinse operation is activate drain pump 40. More specifically, various concurrent and sequential operations of clothes washer 10 are controlled by conventional electromechanical timer 42. In particular, operator actuable control knob 28 is used to start a timer (not shown) that rotates a drum with timing cams (not shown) to open and close switches 44*a* and *b* at preprogrammed times. Here, only two switches 44*a* and *b* of many electromechanical timer switches are shown, and they respectively control activation of motor 36 and drain pump 40. Other alternate controls such as a microprocessor could be used.

Figures 3A, 3B, 3C:
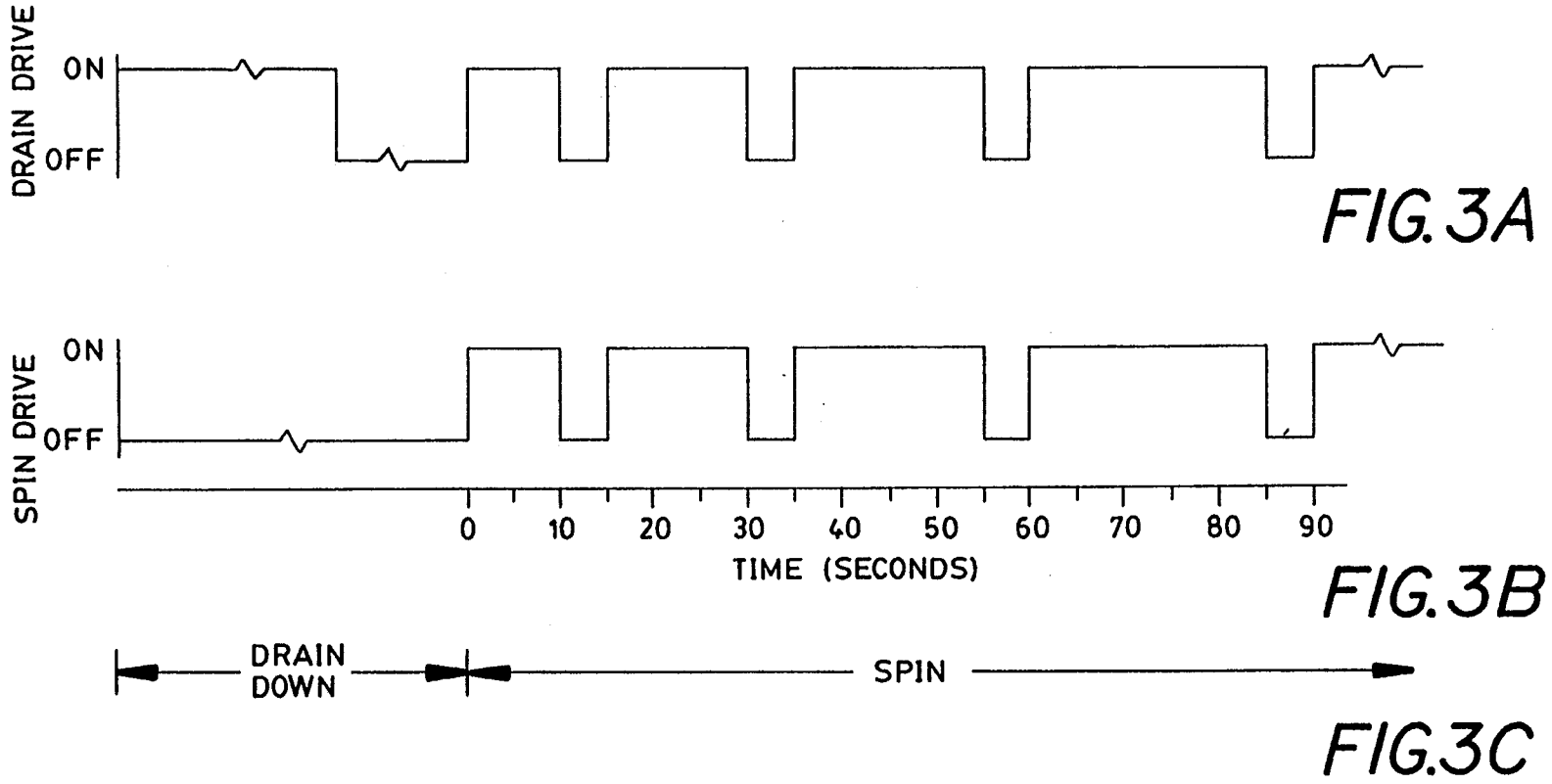
FIGS. 3A and 3B show timing diagrams of the operation of the drain drive and spin drive, respectively.
FIG. 3C shows the relationships of FIGS. 3A and 3B to drain down and spin cycles.

Referring to FIG. 3A, electromechanical timer 42 functions to close switch 44*b* at the beginning of a drain down cycle as shown in FIG. 3C to activate drain pump 40 for a period of time sufficient to pump down the free standing water 34 in wash tub 32. For example, a period of two minutes may be sufficient to drain down the free standing water 34, leaving only the water 34 held by clothes 29. Drain pump 40 is coupled to the bottom wall 46 of wash tub 32 by pump inlet hose 48, and drain pump 40 operates to pump water 34 up pump outlet hose 50 to drain stand pipe 52. As contrasted with an arrangement where the spinning of spin basket 18 is simultaneously initiated and a relatively large drain pump 40 is required to keep pace, a relatively small drain pump 40 can be used because a longer time period such as two minutes can be used to pump down the water 34 in wash tub 32. For example, when the spinning is initiated simultaneous to the drain pump 40, a drain pump 40 with a capacity of 18 gallons per minute may be required to empty the wash tub 32 within a minute. However, when spinning is delayed until after a drain down cycle, a drain pump 40 having a capacity of 10 gallons per minute may typically be used.

Referring to FIG. 3C, a drain down cycle is followed by a spin cycle that functions to extract the water 34 remaining in clothes 29. In particular, switch 44*a* is closed to activate spin drive 54 which here includes motor 36, transmission 38 and shaft 56 that is connected to spin basket 18 to provide rotational drive. As shown in FIG. 3B, AC line voltage is applied to spin drive 54 at the beginning of a spin cycle, here designated as time 0 of a spin cycle. That is, electromechanical timer 42 closes switch 44*a* to energize motor 36 of spin drive 54. As shown in FIG. 3A, drain pump 40 is also activated at time 0 of a spin cycle. Then, after approximately 10 seconds, electromechanical timer 42 opens switches 44*a* and b for approximately 5 seconds to deactivate spin drive 54 and drain pump 40 in unison. During the on time from time 0 to time 10 seconds, spin drive 54 starts spinning spin basket 18 to extract water 34 from clothes 29, but the time period of 10 seconds is insufficient for spin drive 54 to accelerate spin basket 18 up to its maximum spin speed such as, for example, 600 R.P.M. Thus, the maximum spin speed where maximum suds generation occurs is avoided during the initial period of a spin cycle, and suds generation is thereby controlled or limited. That is, less suds are generated than if spin basket 18 were permitted to immediately accelerate up to the maximum spin speed.

In accordance with the invention, deactivating drain pump 40 for approximately 5 seconds also helps to limit a deleterious effect of suds generation. In particular, during the on time of drain pump 40 from time 0 to time 10 seconds of a spin cycle, some suds are generated, and the suds may enter drain pump 40. Suds are compressible, and can not be effectively pumped. In particular, suds may cavitate which means that the same fluid is circulated within the pump, and the net outflow is significantly reduced. In fact, it may lead to suds lock where pumping effectively stops. More specifically, suds lock may occur if suds fill the drain pump 40 and only suds are pumped into outlet hose 50. Under such condition, water 34 and suds extracted from clothes 29 would fill the volume between spin basket 18 and wash tub 32, and the spinning speed would be inhibited by viscous drag in water 34 and suds. When drain pump 40 is deactivated for approximately 5 seconds from time 10 seconds to 15 seconds, the suds float upwardly out of the drain pump 40, and the drain pump 40 fills with water 34. Therefore, when drain pump 40 is energized again at time 15 seconds of a spin cycle, drain pump 40 is primed for efficient pumping. That is, the compressible suds are purged or removed from the drain pump 40, and only incompressible water 34 remains for efficient pumping.

Still referring to FIGS. 3A and 3B, it can be seen that the drain pump 40 and the spin drive 54 are pulsed on and off in unison with increasing on times and constant off times. For example, following the initial on time of 10 seconds and off time of 5 seconds as described heretofore, electromechanical timer 42 cycles drain pump 40 and spin drive 54 on for time periods of 15 seconds, 20 seconds, and 25 seconds, etc, interleaved with 5 second off periods. In such manner, during an initial period of a spin cycle, the spin basket 18 is prevented from reaching a maximum spin speed, and the drain pump 40 is provided with off periods to purge suds and increase pumping efficiency. Eventually, the spin basket 18 is permitted to reach maximum spin speed.

Figure 4:
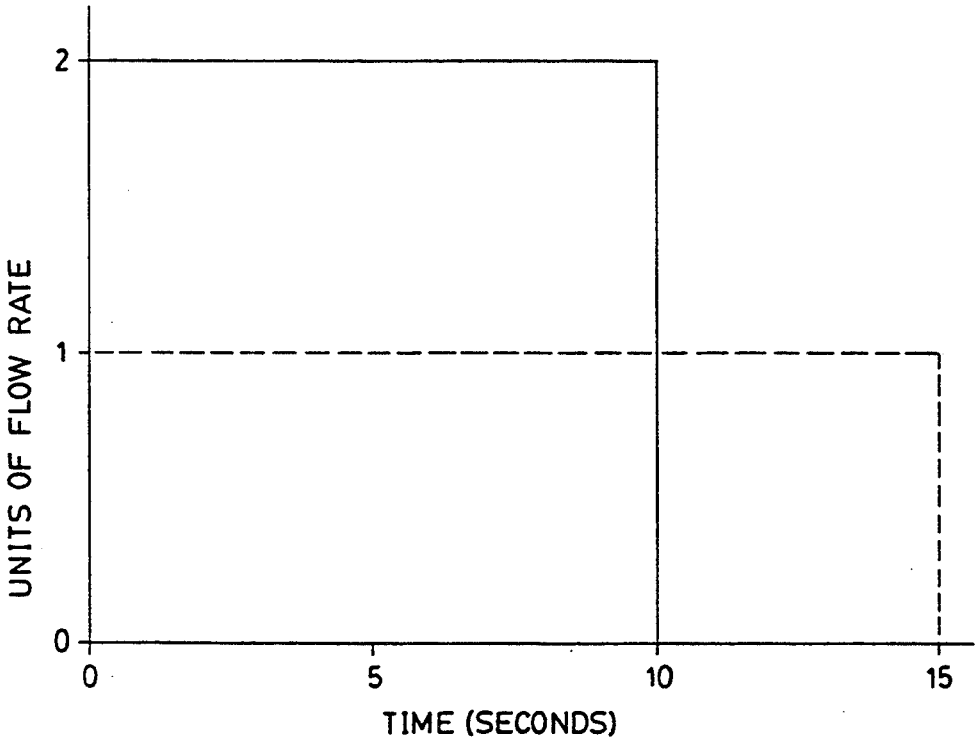
FIG. 4 shows an illustrative depiction of flow rate in accordance with the invention.

Referring to FIG. 4, an illustrative flow rate graph characterizes the potential improvement in providing off times for drain pump 40 during an initial period of a spin cycle. In particular, it is assumed that the solid line depicts a flow rate after drain pump 40 has been purged of suds by being deactivated for 5 seconds. Here, the purged flow rate is illustratively shown to be 2 units per second. Therefore, with 10 seconds of on time followed by 5 seconds of off time, 20 units ($2\times10$) are pumped during a 15 second interval. It is further assumed that the dotted line depicts a flow rate when drain pump 40 has not been purged, and therefore contains a concentration of suds. In particular, the suds cause cavitation that results in a reduced flow rate. Here, the unpurged flow rate is illustratively shown to be 1 unit per second. Therefore, in the 15 seconds of on time, 15 units ($1\times15$) will be pumped. In the same 15 second time period, the purged drain pump 40 pumps more with a 5 second off time than the reduced flow rate with a 100% duty cycle. Thus, in accordance with the invention, a smaller drain pump 40 can be used even though the duty cycle is less than 100%.

This concludes the Description of the Preferred Embodiment. A reading of it by those skilled in the art will bring to mind many modifications and alterations that do not depart from the spirit and scope of the invention. Therefore, it is intended that the scope of the invention be limited only by the appended claims.

What is claimed is:

1. In an automatic top-loading clothes washer having a wash tub with a perforated inner spin basket rotatable by a spin drive and a drain pump for pumping water from the wash tub, a method of draining water from the wash tub and spinning the spin basket to extract water from clothes in the spin basket, comprising the steps of:

activating the drain pump to pump down water in the wash tub;

activating the spin drive with a predetermined on and off schedule to prevent the spin basket from reaching a maximum spin speed during an initial period of a spin cycle after pumping down water in the wash tub; and activating the drain pump with said predetermined on and off schedule to turn said spin drive and drain pump on and off together in complete unison during the initial period of the spin cycle to purge the pump of compressible fluid during off time.

2. The method recited in claim 1 wherein the predetermined on and off schedule of the spin drive and drain pump has increasing on times until the maximum spin speed is reached.

3. The method recited in claim 2 wherein the predetermined on and off schedule of the spin drive and drain pump has constant off times until the maximum spin speed is reached.

4. In an automatic top-loading clothes washer having a wash tub with a perforated inner spin basket rotatable by a spin drive and a drain pump for pumping water from the wash tub, a method of draining water from the wash tub and spinning the spin basket to extract water from clothes in the spin basket, comprising the steps of:

activating the drain pump to pump down water in the wash tub;

activating the spin drive with a predetermined on and off schedule to prevent the spin basket from reaching a maximum spin speed during an initial period of a spin cycle after pumping down water in the wash tub;

activating the drain pump with a predetermined on and off schedule during the initial period of the spin cycle to purge the pump of compressible fluid during off time; and wherein, during said initial period of the spin cycle, the spin drive and the drain pump are initially scheduled on in unison for a period of approximately 10 seconds, and then scheduled off in unison for a period of approximately 5 seconds to prevent the spin basket from reaching the maximum spin speed and to purge compressible fluid from the drain pump

5. The method recited in claim 5 wherein the initial off periods of the spin drive and the drain pump are followed by respective on periods of approximately 15 seconds followed by respective off periods of approximately 5 seconds.

6. In an automatic top-loading clothes washer having a wash tub with a perforate inner clothes receiving spin basket rotatable by a spin drive and a drain pump for pumping water from the wash tub, apparatus comprising:

means for activating the drain pump to pump down water in the wash tub;

means for activating the spin drive with a predetermined on and off schedule to prevent the spin basket from reaching a maximum spin speed during an initial period of a spin cycle after pumping down water in the wash tub;

means for activating the drain pump with a predetermined on and off schedule during the initial period of the spin cycle to purge the pump of compressible fluid during off time; and wherein the spin drive and drain pump activating means comprise means for initially scheduling the spin drive and the drain pump on in unison for a period of approximately 10 seconds during the initial period of the spin cycle, and then scheduling the spin drive and the drain pump off in unison for a period of approximately 5 seconds to prevent the spin basket from reaching the maximum spin speed and to purge compressible fluid from the drain pump.

7. The apparatus recited in claim 6 wherein the spin drive activating means comprises means for increasing on times while maintaining constant off times until the maximum spin speed is reached.

8. The apparatus recited in claim 6 wherein the spin drive and drain pump activating means comprise means for scheduling off times of the spin drive and drain pump in unison.

9. The apparatus recited in claim 6 wherein the spin drive and drain pump activating means comprise means for scheduling the spin drive and the drain pump on in unison for a period of approximately 15 seconds after the initial off periods, and then scheduling the spin drive and the drain pump off in unison for a period of approximately 5 seconds.

10. An automatic top loading clothes washer comprising:

a wash tub;

a perforated spin basket disposed within the wash tub, said spin basket being adapted for receiving a load of clothes to be washed;

means for filling the wash tub with water;

an agitator disposed in said spin basket for agitating the clothes;

a drain pump coupled to said wash tub for pumping water from the wash tub;

a spin drive for spinning said spin basket to extract water from the clothes;

a controller comprising means for first activating said drain pump to pump down water in said wash tub, and then pulsing activation of said spin drive and said drain pump on a predetermined schedule of on and off times to extract water from the clothes while preventing the spin basket from reaching a maximum spin speed during an initial period of a spin cycle, and also purging compressible fluid from said drain pump during off times; and said controller comprising means for increasing on times while maintaining constant off times wherein said off times are approximately 5 seconds and said on times increase from approximately 10 seconds to approximately 15 seconds.

11. The clothes washer recited in claim 10 wherein said controller comprises an electromechanical timer.

12. The clothes washer recited in claim 10 wherein said on times increase until said spin basket reaches said maximum spin speed.

* * * * *